US009592937B1

(12) United States Patent
Wang

(10) Patent No.: US 9,592,937 B1
(45) Date of Patent: Mar. 14, 2017

(54) TAMPER-EVIDENT CONTAINER STRUCTURE

(71) Applicant: SOUTH PLASTIC INDUSTRY CO., LTD., New Taipei, TN (US)

(72) Inventor: Tong-Chang Wang, New Taipei (TW)

(73) Assignee: SOUTH PLASTIC INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/842,842

(22) Filed: Sep. 2, 2015

(51) Int. Cl.
*B65D 17/353* (2006.01)
*B65D 43/02* (2006.01)
*B65D 1/34* (2006.01)

(52) U.S. Cl.
CPC ..... *B65D 43/0237* (2013.01); *B65D 1/34* (2013.01); *B65D 43/0254* (2013.01); *B65D 2101/0015* (2013.01)

(58) Field of Classification Search
CPC .. B65D 43/0237; B65D 1/34; B65D 43/0239; B65D 43/0241; B65D 43/0245; B65D 43/0254; B65D 2101/0015
USPC ..... 220/266, 270, 789, 791
See application file for complete search history.

(56) References Cited

U.S. PATENT DOCUMENTS

2011/0000929 A1* 1/2011 Brown ..... B65D 43/162 220/810
2013/0160406 A1* 6/2013 Johnston ..... B65B 7/26 53/467
2015/0028033 A1* 1/2015 Samuel ..... B65D 43/0266 220/270

* cited by examiner

*Primary Examiner* — James N Smalley
(74) *Attorney, Agent, or Firm* — Leong C. Lei

(57) ABSTRACT

Disclosed is a tamper-evident container for food storage that uses a round male to female post lock on a single corner. After the cover is locked to the tray base, it requires breaking the corner tray tab to open the container. This tab tear off provides positive evidence of container opening to indicate the container has been opened or tampered with.

8 Claims, 10 Drawing Sheets

TAMPER-EVIDENT CONTAINER STRUCTURE (a) Technical Field of the Invention

The present invention relates generally to a tamper-evident container structure, which comprises a plastic tray base and a cover that are attachable to each other with a first post and a second post coupled to each other, wherein the plastic tray base is provided on a circumference thereof with a first flange that is greater than a second flange provided along a circumference of the cover, so that unauthorized opening of the cover is prevented, unless a tear-off section that is formed at a predetermined location on a first protrusion with perforation lines provided on opposite sides of the tear-off section and a cut-off section formed between the perforation lines and the plastic tray base is torn to allow for opening and lifting of the cover, thereby providing a tamper evident effect.

(b) Description of the Prior Art

Various plastic containers that are made through vacuum forming are available, including boxes, cups, or bowls, which are fit for storage of food for keeping the food fresh. Such products are generally made of clear materials, allowing general consumers to see therethrough to observe food therein when they intend to purchase the food and this eliminates unnecessary arguing and quarrels after the sale. However, to inspect the food contained in such a container is intact and fresh, some consumers may open, without permission and authorization, the container to directly inspect the food. Some of such food containers, after being opened by the consumers, are not properly sealed to the original condition so that the food contained therein may get contaminated or spoiled. In addition, this may also lead to damage of the plastic container and affects the outside appearance of the container. Further, if it is not timely recognized that the package container has been tampered and opened, deterioration of the food contained therein would cause a waste of food and is also an economic burden of the shops.

Although temper evident containers are known, the conventional tamper evident containers often have a locking method that permits defeating the temper evident features using finger nails or pry tool to lift the cover.

In view of these problems, the present invention aims to provide a tamper-evident container, which provides a tamper evident effect to eliminate the drawbacks and deficiency of the prior art devices.

SUMMARY OF THE INVENTION

Thus, to prevent damage of the outside appearance of a plastic container and food contained in the container losing freshness resulting from unauthorized opening and tampering of the plastic container, the primary object of the present invention is to provide a tamper-evident container structure, which comprises a plastic tray base, a cover, a first protrusion section, a second protrusion section, a first post, a second post, perforation lines, and a cut-off section to provide a tamper indicating effect of ready identification of unauthorized opening or tampering.

To achieve the above objects, the present invention provides a tamper-evident container structure, which generally comprises a plastic tray base, the plastic tray base having one surface that is open and an opposite surface that is closed, the plastic tray base having an interior space in which at least one stop block is formed in such a way that the stop block circumferentially extends along an inner circumference of the plastic tray base, the plastic tray base having an outer circumference on which a first flange is formed in such a way that the first flange circumferentially extends around the plastic tray base;

a cover, which is coupled to the open surface of the plastic tray base to selectively close the plastic tray base, the cover having an outer circumference on which a second flange is formed in such a way that the second flange circumferentially extends around the cover and at least one downward-projecting block formed inboard and at an inner side of the second flange, length and width of the second flange being smaller than length and width of the first flange;

at least one first protrusion, which is formed at a predetermined location on the circumference of the plastic tray base, the first protrusion comprising at least one tear-off section formed at a predetermined location thereof, at least one perforation line being formed at a connection between the tear-off section and the first protrusion, a cut-off section being formed between the tear-off section and the plastic tray base, the tear-off section comprising at least one first post formed at a predetermined location thereof and a first recess; and at least one second protrusion, which is formed at a predetermined location on the circumference of the cover, the second protrusion comprising at least one second post formed at a predetermined location thereof and a second recess, the second post and the first post being engageable with each other to tightly couple the first protrusion and the second protrusion to each other, the first recess and the second recess being in mating engagement with each other.

In the above-described first protrusion, the first protrusion has a middle section that comprises the tear-off section formed therein.

In the above-described tear-off section, the first post is formed on a surface of the tear-off section.

In the above-described first post, the first post has a lower portion on which an engagement block is formed to circumferentially extend along an inner circumference of the first post and the first post is a raised triangular block.

In the above-described second protrusion, the second post is formed on a surface of the second protrusion.

In the above-described second post, the second post has a lower end on which a projection block is formed to circumferentially surround the second post and the second post is a raised triangular block, so that engagement between the projection block and the engagement block couples the first post and the second post to each other.

In the above-described first recess, the first recess is arranged in a portion of the tear-off section of the first protrusion that is put into engagement with the second protrusion.

In the above-described second recess, the second recess is arranged in a portion of the second protrusion that is put into engagement with the tear-off section.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
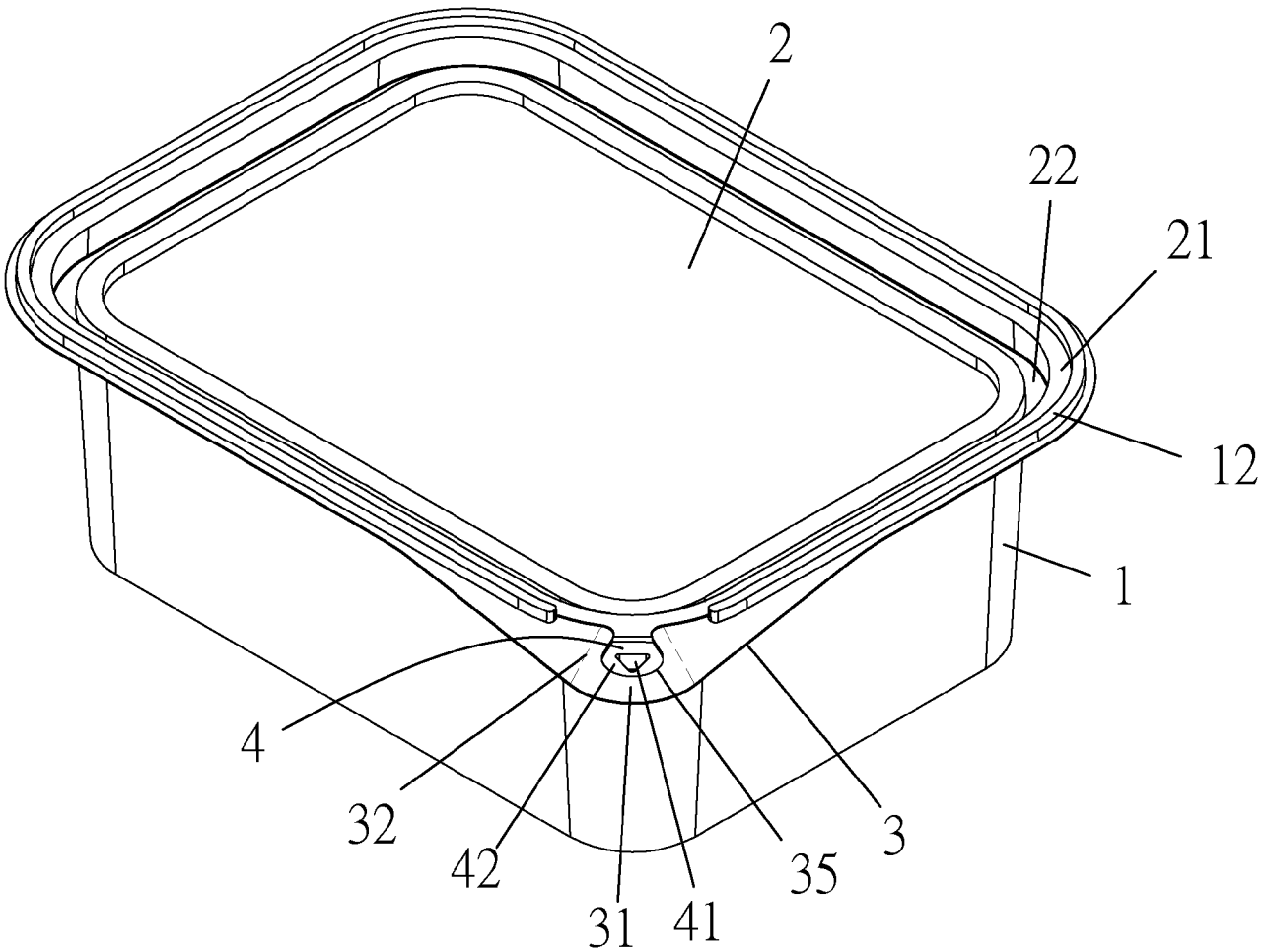
FIG. 1 is a perspective view of the present invention.
Figure 2:
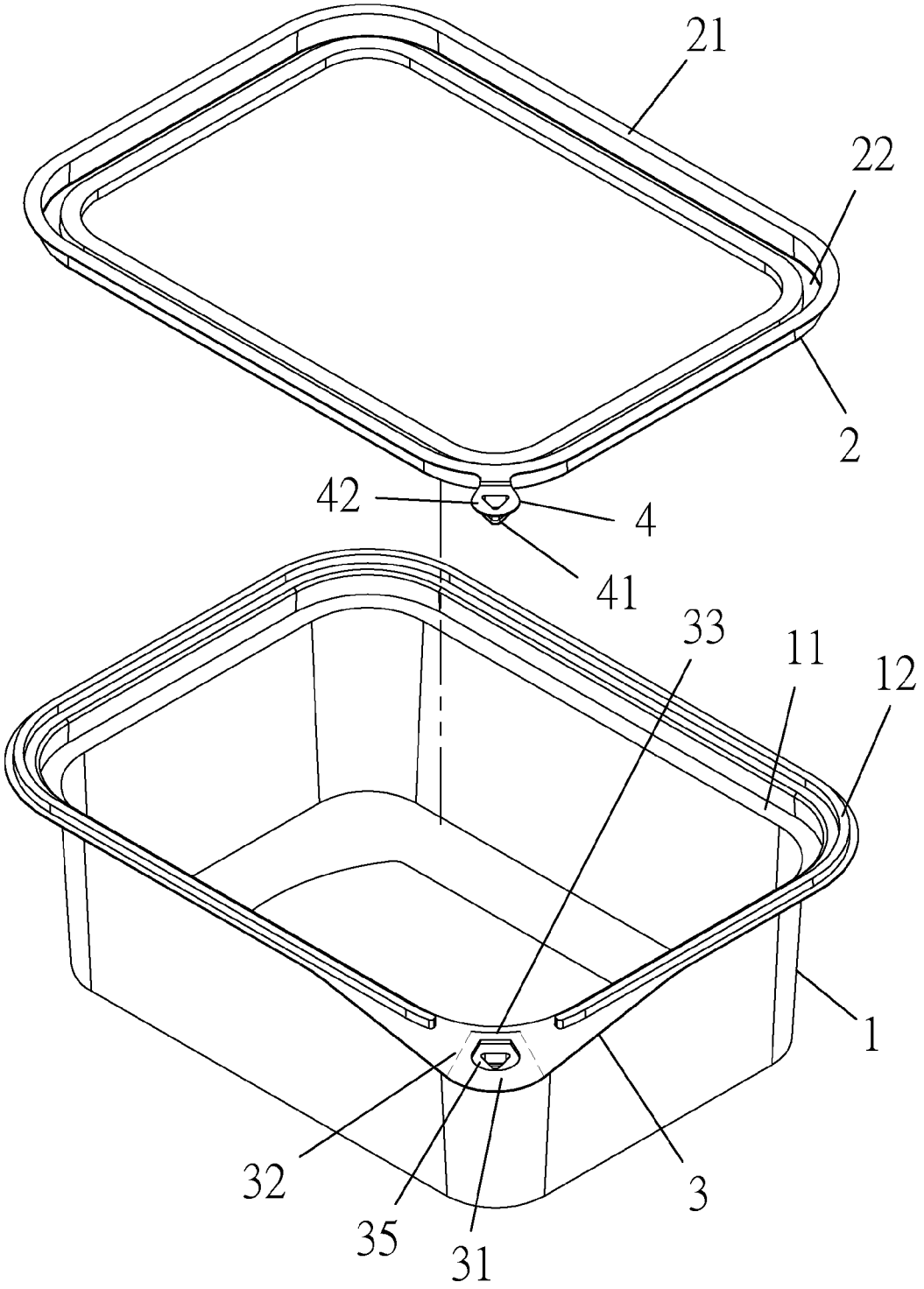
FIG. 2 is an exploded view of the present invention.

Referring to FIGS. 1 and 2, which are respectively a perspective view and an exploded view of the present invention, as shown in the drawings, the present invention generally comprises a plastic tray base 1. The plastic tray base 1 has one surface that is open and an opposite surface that is closed. The plastic tray base 1 has an interior space in which at least one stop block 11 is formed in such a way that the stop block 11 circumferentially extends along an inner circumference of the plastic tray base 1. The plastic tray base 1 has an outer circumference on which a first flange 12 is formed in such a way that the first flange 12 circumferentially extends around the plastic tray base 1.

A cover 2 is coupled to the open surface of the plastic tray base 1 to selectively close the plastic tray base 1. The cover 2 has an outer circumference on which a second flange 21 is formed in such a way that the second flange 21 circumferentially extends around the cover 2 and at least one downward-projecting block 22 formed inboard and at an inner side of the second flange 21. Length and width of the second flange 21 are smaller than length and width of the first flange 12.

At least one first protrusion 3 is formed at a predetermined location on the circumference of the plastic tray base 1. The first protrusion 3 has a middle section in which at least one tear-off section 31 is formed. At least one perforation line 32 is formed at a connection between the tear-off section 31 and the first protrusion 3 and a cut-off section 33 is formed between the tear-off section 31 and the plastic tray base 1. At least one first post 34 is formed on a surface of the tear-off section 31. The tear-off section 31 is provided, at a predetermined location thereof, with a first recess 35.

At least one second protrusion 4 is formed at a predetermined location on the circumference of the cover 2. At least one second post 41 is formed on a surface of the second protrusion 4. The second protrusion 4 is provided, at a predetermined location thereof, with a second recess 42. The second post 41 and the first post 34 are structured to mate and thus in coupled engagement with each other to couple the first protrusion 3 and the second protrusion 4 to each other. The first recess 35 and the second recess 42 are in mating engagement with each other.

In the structure of the first post 34 described above, the first post 34 has a lower portion that comprises an engagement block 341, which, defining a groove, circumferentially extends along an inner circumference of the first post 34. The first post 34 may be a triangular raised block.

In the structure of the second post 41 described above, the second post 41 is a triangular raised block and the second post 41 has a lower portion that comprises a projection block 411 formed thereon to circumferentially surround the second post 41. Mutual mating engagement between the projection block 411 and the engagement block 341 couples and joins the first post 34 and the second post 41 to each other.

In the structure of the first recess described above, the first recess is arranged in a portion of the tear-off section of the first protrusion that is put into engagement with the second protrusion.

In the structure of the second recess described above, the second recess is arranged in a portion of the second protrusion that is put into engagement with the tear-off section.

Figure 3:
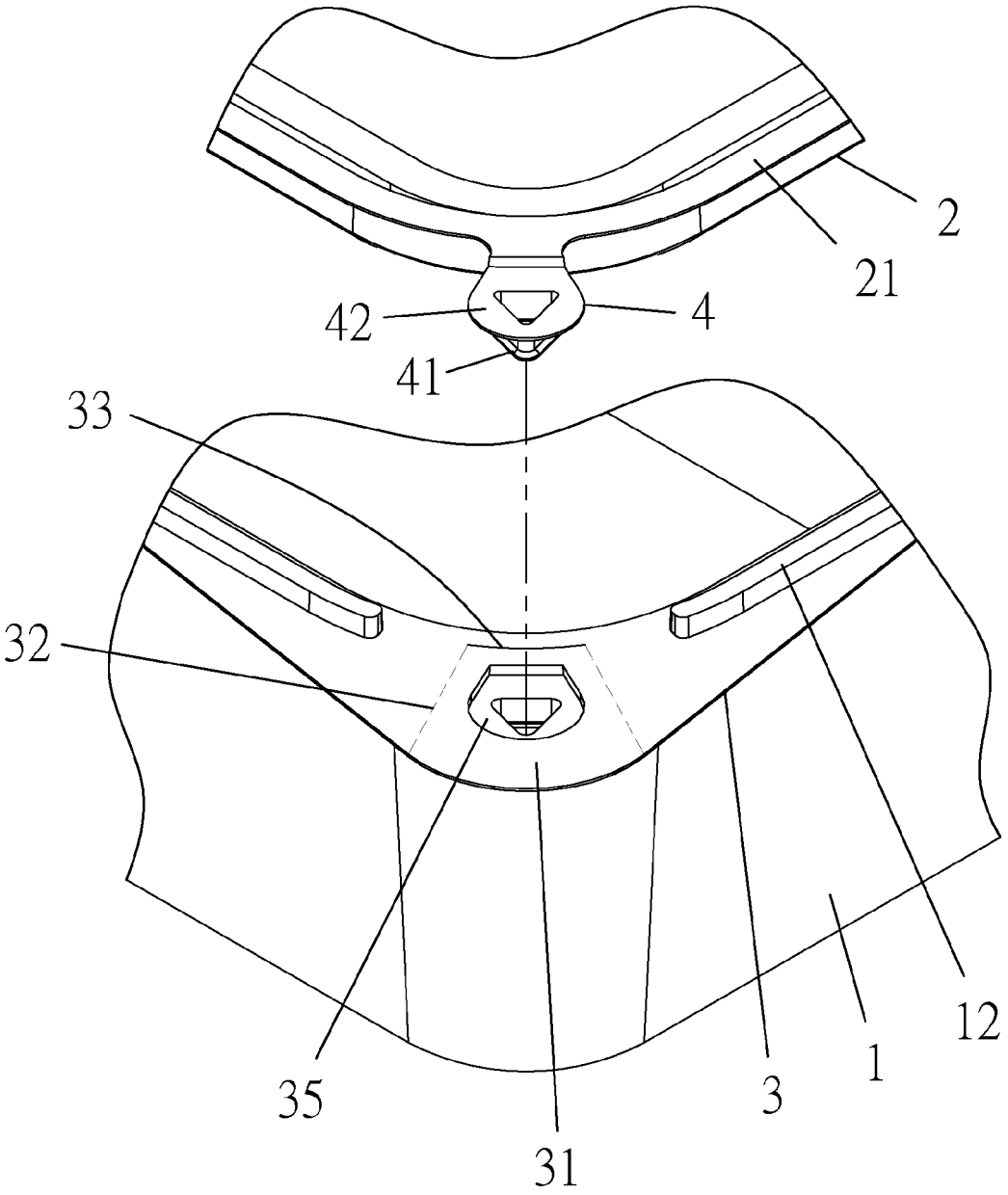
FIG. 3 is a schematic view showing a portion of the present invention.
Figure 4:
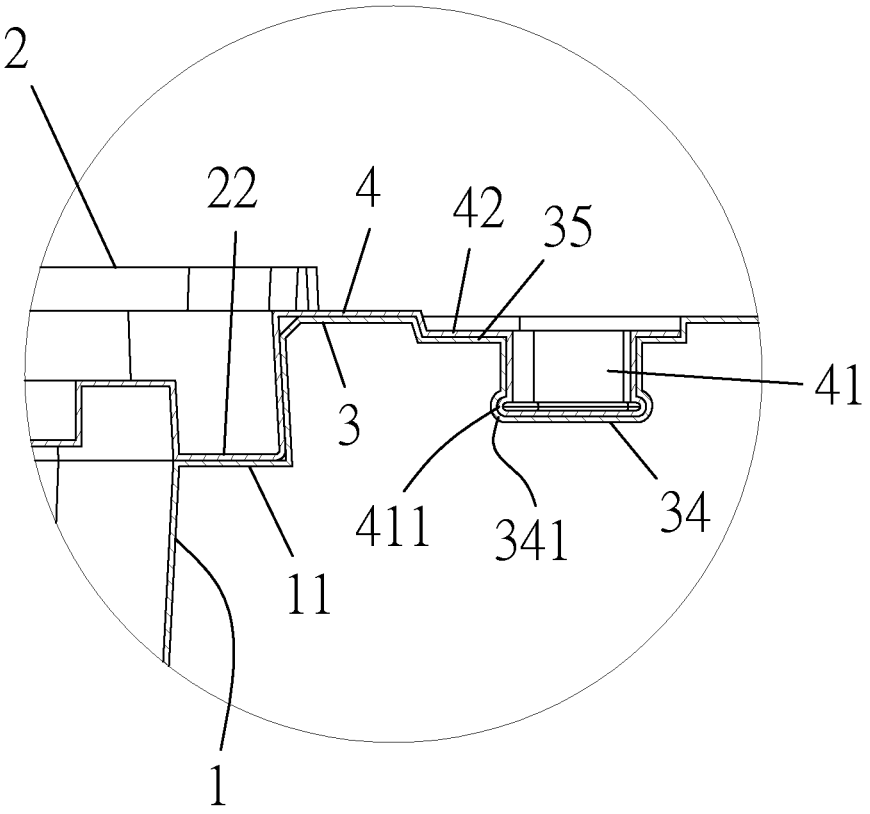
FIG. 4 is a cross-sectional view showing a portion of the present invention.

Referring to FIGS. 3 and 4, which are respectively a schematic view showing a portion of the present invention and a cross-sectional view showing a portion of the present invention, as shown in the drawings, the plastic tray base 1 is closed and sealed through tight engagement between the stop block 11 and the downward-projecting block 22 and between the first flange 12 and the second flange 21. In addition, the projection block 411 that is formed on the upper portion of the first post 34 and circumferentially surrounding the first post 34 and the engagement block 341 that is arranged on the upper portion of the second post 41 and circumferentially extends and surrounds an inner circumference of the second post 41 are structured to allow the projection block 411 and the engagement block 341 to mate and engage each other so as to couple the first post 34 and the second post 41 to each other thereby coupling the first protrusion 3 and the second protrusion 4 together to effectively and hermetically combine the plastic tray base 1 and the cover 2.

Figure 5:
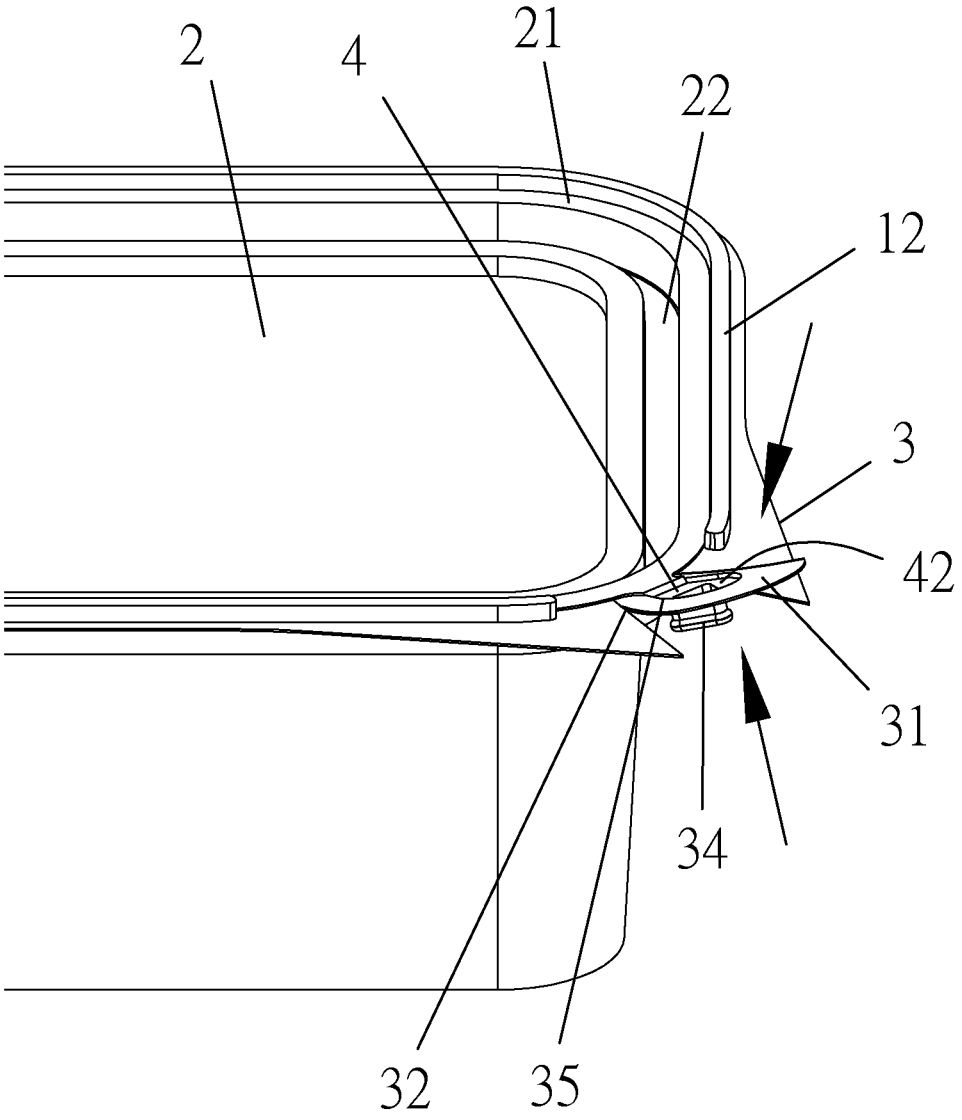
FIG. 5 is a schematic view illustrating a recess of the present invention.

As shown in FIG. 5, which is a schematic view illustrating a recess of the present invention, as shown in the drawing, the tear-off section 31 of the first protrusion 3 is provided with the first recess 35 at the connection thereof with the second protrusion 4; and the second protrusion 4 is provided with the second recess 42 at the connection thereof with the tear-off section 31. Mating engagement between the first recess 5 and the second recess 6 makes the section protrusion 4 received and embedded in the first recess 35 so as to effectively prevent a user from lifting off the cover 2 by means of the second protrusion 4 using finger nails or pry tool, thereby achieving a tamper indicating effect.

Figure 6:
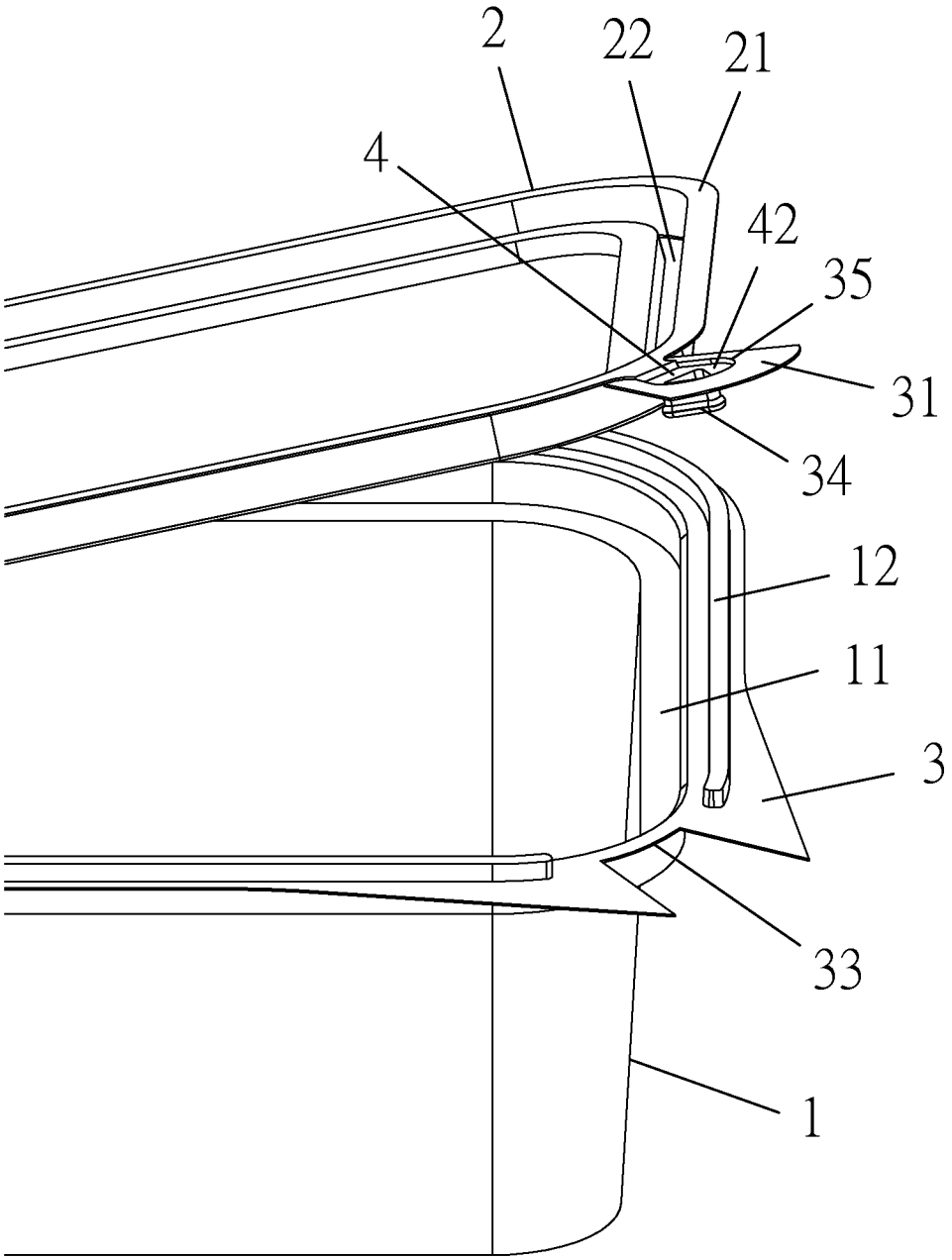
FIG. 6 is a view illustrating a use of the present invention.
Figure 7:
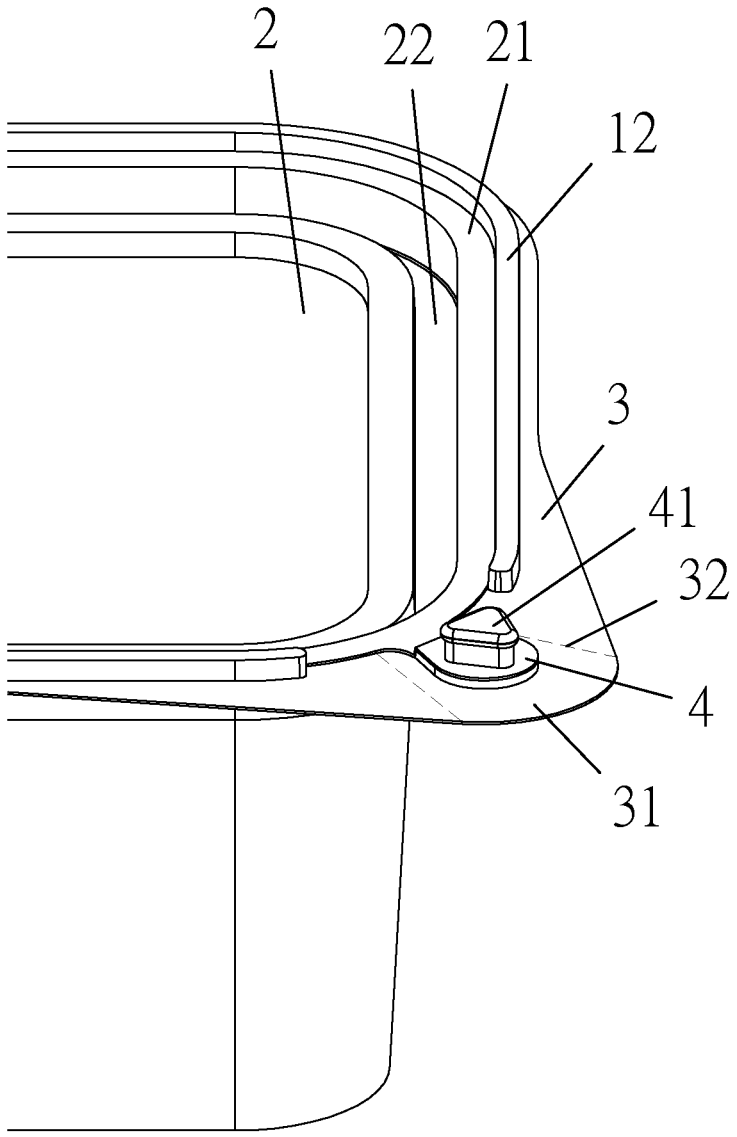
FIG. 7 is a view illustrating a use of the present invention.

Referring to FIGS. 6 and 7, which are views illustrating a use of the present invention, as shown in the drawings, the first protrusion 3 and the second protrusion 4 are coupled together through coupling between the first post 34 and the second post 41. In an attempt to open the cover 2, a user applies a force to the first protrusion 3 in a downward direction and also applies a force to the tear-off section 31 in an upward direction so that the forces that are opposite to each other and respectively in the upward and downward directions cause the tear-off section 31 to be torn along the perforation line 32 to the cut-off section 33 and thus lifted upward. Once the tear-off section 31 is completely torn, the cover 2 is free to open and lift. As such, positive evidence is provided for tampering indication of unauthorized opening and access.

Figure 8:
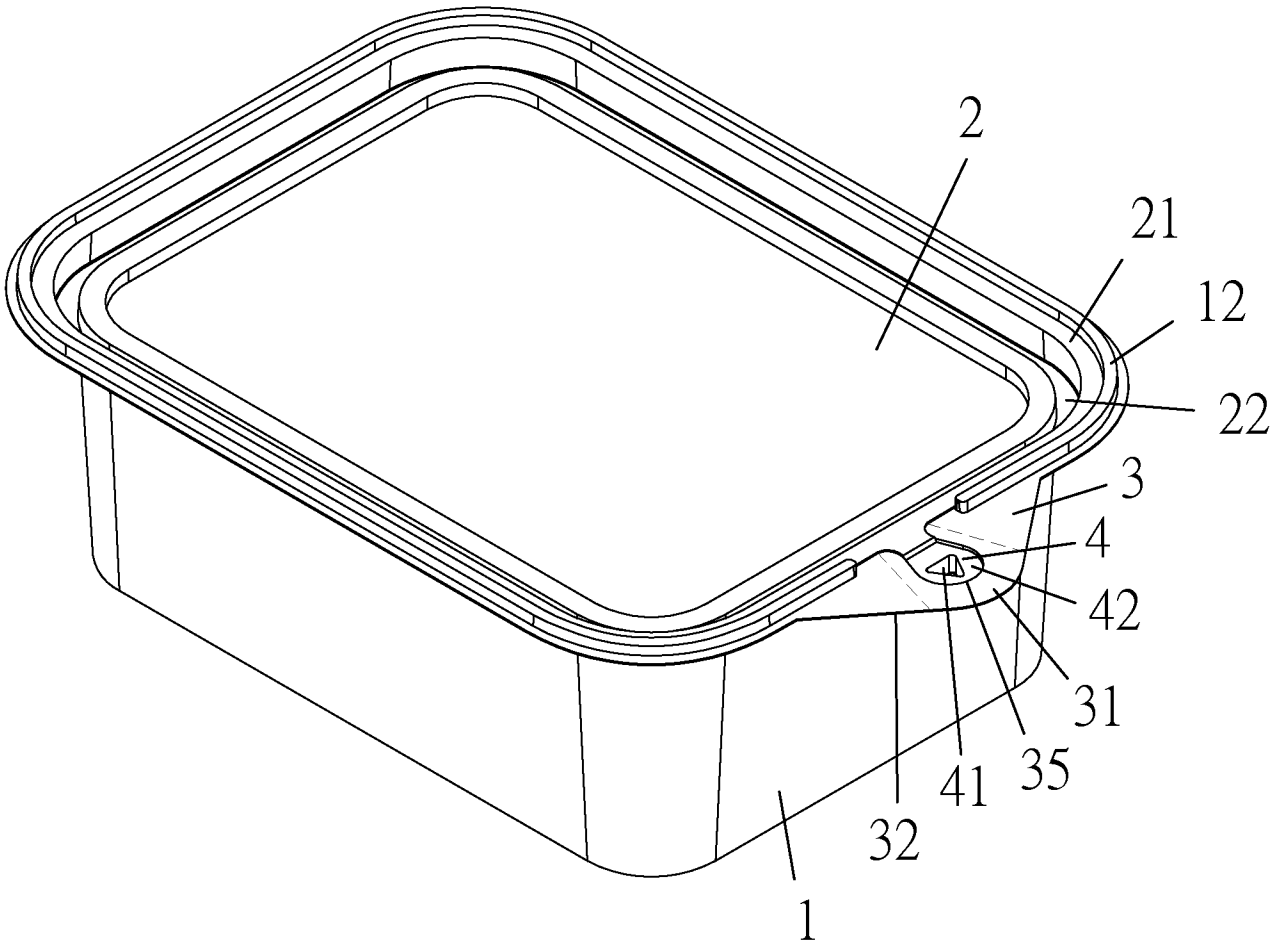
FIG. 8 is a view illustrating an embodiment of posts of the present invention.

Referring to FIG. 8, which is a view illustrating an embodiment of the posts of the present invention, as shown in the drawing, the first post 34 is formed on a surface of the tear-off section 31 and the first post 34 has an upper portion that comprises a projection block 411 that circumferentially surrounds the first post 34. The second post 41 is provided on a surface of the second protrusion 4 and the second post 41 has an upper section that comprises an engagement block 341 circumferentially surrounding the second post 41. Mating engagement between the projection block 411 and the engagement block 341 couples the first post 34 and the second post 41 to each other so as to have the first protrusion 3 and the second protrusion 4 tightly coupled to each other.

Figure 9:
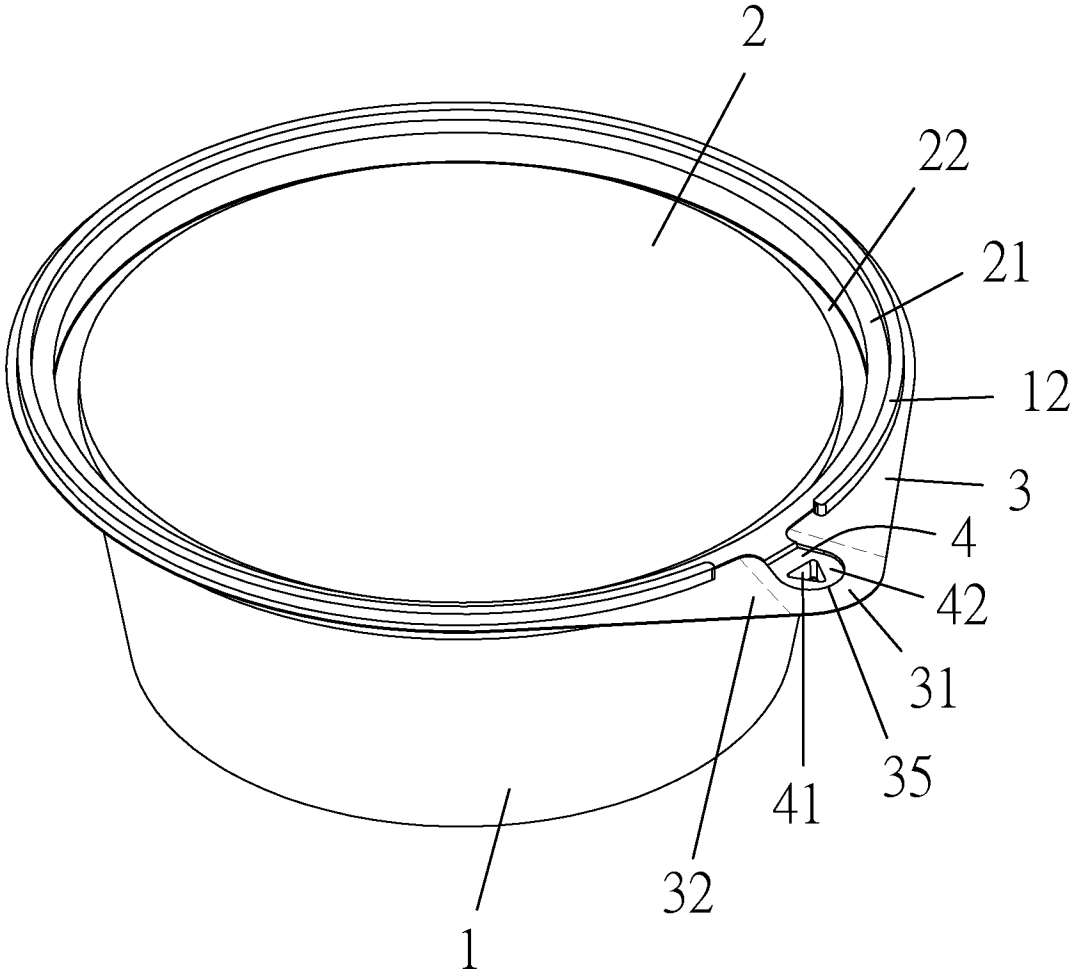
FIG. 9 is a view illustrating an embodiment of protrusions of the present invention.

Referring to FIG. 9, which is a view illustrating another embodiment of the protrusions of the present invention, as shown in the drawing, the first protrusion 3 is arranged at one side, one corner, or any location of the plastic tray base 1 and the second protrusion 4 is correspondingly arranged at one side, one corner, or any location of the cover 2. Coupling achieved between the first post 34 and the second post 41 couples the first protrusion 3 and the second protrusion 4 to each other to provide the same effect as described above.

Figure 10:
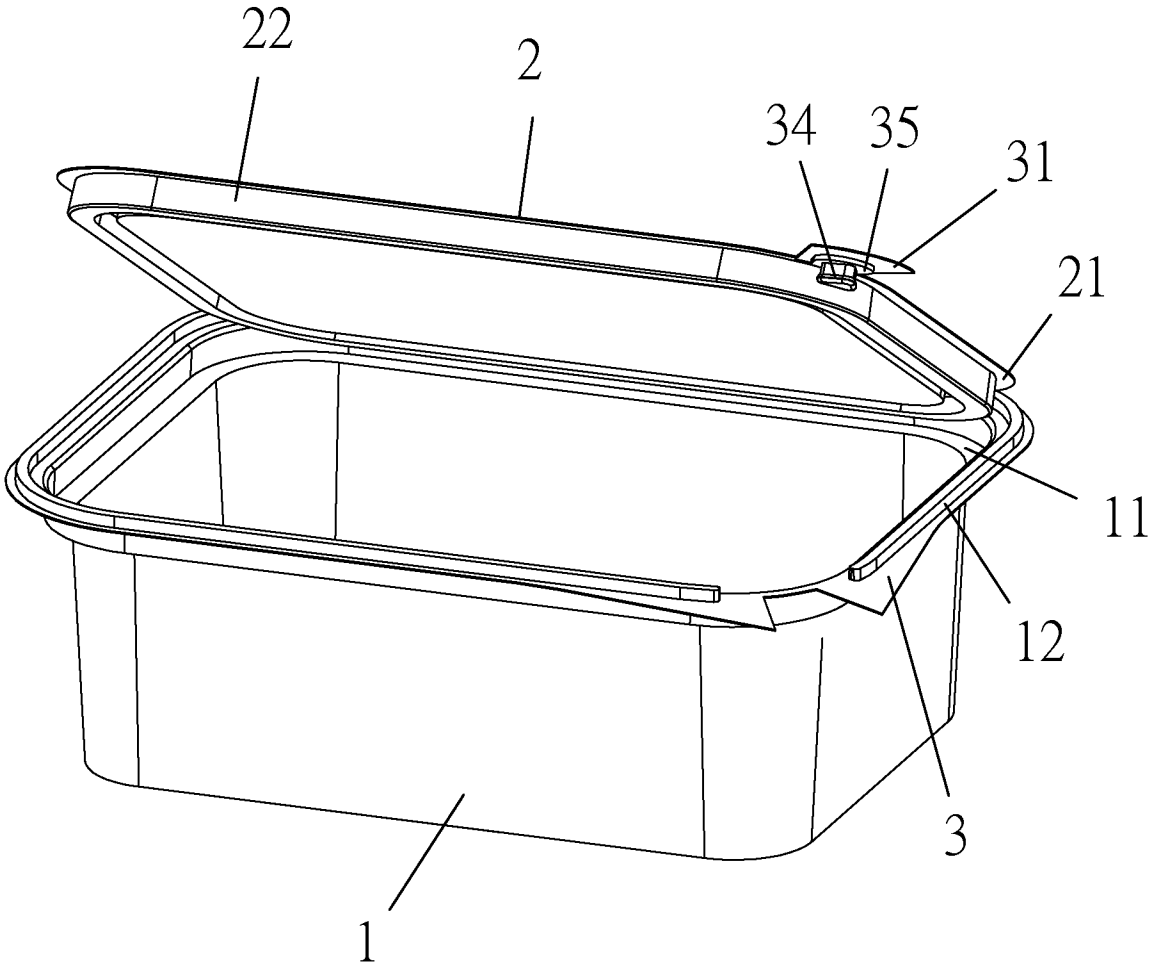
FIG. 10 is a view illustrating an embodiment of a plastic tray base and a cover of the present invention.

Referring to FIG. 10, which is a view illustrating another embodiment of the plastic tray base and the cover of the present invention, as shown in the drawing, the plastic tray base 1 and the cover 2 are connected to each other in a pivoting manner at one side thereof for effectively closing or opening the plastic tray base 1.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A tamper-evident container structure, comprising:

a plastic tray base, which has a side that is open and an opposite side that is closed, the plastic tray base having an interior space in which at least one stop block is formed in such a way that the stop block circumferentially extends along an inner circumference of the plastic tray base, the plastic tray base having an outer circumference on which a first flange is formed in such a way that the first flange circumferentially extends around the plastic tray base;

a cover, which is coupled to the open surface of the plastic tray base to selectively close the plastic tray base, the cover having an outer circumference on which a second flange is formed in such a way that the second flange circumferentially extends around the cover and at least one downward-projecting block formed inboard and at an inner side of the second flange, the length and width of the second flange being smaller than the length and width of the first flange;

at least one first protrusion, which is formed at a predetermined location on the circumference of the plastic tray base, the first protrusion comprising at least one tear-off section formed at a predetermined location thereof, at least one perforation line being formed at a connection between the tear-off section and the first protrusion, a cut-off section being formed between the tear-off section and the plastic tray base, the tear-off section comprising at least one first post and a first recess formed at a predetermined location thereof; and at least one second protrusion, which is formed at a predetermined location on the circumference of the cover, the second protrusion comprising at least one second post and a second recess formed at a predetermined location thereof, the second post and the first post being engageable with each other to tightly couple the first protrusion and the second protrusion to each other, mating engagement between the first recess and the second recess making the second protrusion received and embedded in the first recess so as to effectively prevent a user from lifting off the cover by means of the second protrusion using a finger nail or a pry tool.

2. The tamper-evident container structure according to claim 1, wherein the first protrusion is arranged at a location on one side, one end, or one corner of the circumference of the plastic tray base, the first protrusion having a middle section in which the tear-off section is formed, the second protrusion being arranged at a location on one side, one end, or one corner of the circumference of the cover.

3. The tamper-evident container structure according to claim 2, wherein the first post is formed on an undersurface of the tear-off section, the first post having a lower portion on which the engagement block is formed to surround the first post, the second post being formed on an undersurface of the second protrusion, the second post having a lower portion on which the projection block is formed to surround the second post, the projection block and the engagement block being engageable with each other to couple the first post and the second post to each other so as to have the first protrusion and the second protrusion tightly coupled to each other.

4. The tamper-evident container structure according to claim 2, wherein the plastic tray base has a shape of one of a circle, a trapezoid, a rectangle, and a triangle.

5. The tamper-evident container structure according to claim 2, wherein the cover has a shape of one of a circle, a trapezoid, a rectangle, and a triangle.

6. The tamper-evident container structure according to claim 3, wherein the first post is a raised triangular block.

7. The tamper-evident container structure according to claim 3, wherein the second post is a raised triangular block.

8. The tamper-evident container structure according to claim 3, wherein the first post is formed on a surface of the tear-off section and the second post is formed on a surface of the second protrusion, the projection block and the engagement block being engageable with each other to couple the first post and the second post to each other to have the first protrusion and the second protrusion tightly coupled to each other.

* * * * *